US006890890B2

(12) United States Patent
Gahagan

(10) Patent No.: US 6,890,890 B2
(45) Date of Patent: May 10, 2005

(54) LUBRICANTS WITH THE COMBINATION OF A MOLYBDENUM COMPOUND, A PHOSPHORUS COMPOUNDS AND DISPERSANTS

(75) Inventor: Michael P. Gahagan, Derbyshire (GB)

(73) Assignee: The Lubrizol Corporation, Wickliffe, OH (US)

( * ) Notice: Subject to any disclaimer, the term of this patent is extended or adjusted under 35 U.S.C. 154(b) by 86 days.

(21) Appl. No.: 10/645,374

(22) Filed: Aug. 21, 2003

(65) Prior Publication Data

US 2004/0038834 A1 Feb. 26, 2004

Related U.S. Application Data

(63) Continuation of application No. 09/748,318, filed on Dec. 22, 2000, now abandoned.
(60) Provisional application No. 60/171,357, filed on Dec. 22, 1999.

(51) Int. Cl.[7] ..... C10M 141/12
(52) U.S. Cl. ..... 508/192; 508/287; 508/364; 508/379; 508/428; 508/436; 508/442; 508/542
(58) Field of Search ..... 508/192

(56) References Cited

U.S. PATENT DOCUMENTS

| | | | | |
|---|---|---|---|---|
| 3,197,405 A | | 7/1965 | Le Suer | 252/32.7 |
| 3,541,014 A | | 11/1970 | Le Suer | 252/49.7 |
| 4,601,837 A | | 7/1986 | Valcho et al. | 252/40.7 |
| 4,704,215 A | | 11/1987 | Hata et al. | 252/32.7 |
| 5,143,633 A | | 9/1992 | Gallo et al. | 252/18 |
| 5,356,547 A | | 10/1994 | Arai et al. | 252/46.4 |
| 5,605,880 A | * | 2/1997 | Arai et al. | 508/379 |
| 5,672,572 A | | 9/1997 | Arai et al. | 508/364 |
| 5,688,748 A | | 11/1997 | Tomizawa | 508/363 |
| 5,707,942 A | | 1/1998 | Arai et al. | 508/365 |
| 5,925,600 A | | 7/1999 | Atherton | 508/364 |

FOREIGN PATENT DOCUMENTS

| | | |
|---|---|---|
| EP | 0 677 571 A1 | 10/1995 |
| EP | 0 757 093 A1 | 2/1997 |
| EP | 0 855 437 A1 | 7/1998 |
| WO | 96/37585 | 11/1996 |

OTHER PUBLICATIONS

PCT/US00/35339; PCT International Search Report mailed Apr. 9, 2001.
European Search Report, Application No. EP 00 98 8377, dated Feb. 2, 2004.

* cited by examiner

*Primary Examiner*—Ellen M. McAvoy
(74) *Attorney, Agent, or Firm*—Teresan W. Gilbert; Michael F. Esposito

(57) ABSTRACT

This invention relates to a lubricating composition comprising a major amount of an oil of lubricating viscosity, (A) an antiwear improving amount of at least one molybdenum containing composition, (B) at least one phosphorus antiwear or extreme pressure agent, and (C) at least one dispersant, provided that the lubricating composition is free of polysulfurized olefins. The lubricating compositions have improved antiwear properties. When the lubricating composition is used in a manual transmission, the amount of brass wear is reduced.

13 Claims, No Drawings

LUBRICANTS WITH THE COMBINATION OF A MOLYBDENUM COMPOUND, A PHOSPHORUS COMPOUNDS AND DISPERSANTS

CROSS REFERENCE TO RELATED APPLICATION

This application is a continuation of U.S. Ser. No. 09/748,318, filed Dec. 22, 2000 now abandoned, Which also claims priority from provisional application Ser. No. 60/171,357, filed Dec. 22, 1999, the entire disclosure which is hereby incorporated by reference.

FIELD OF THE INVENTION

This invention relates to a lubricating composition comprising a combination of a molybdenum containing compound, a phosphorus compound and a dispersant. These compositions are particularly mild on yellow metal components of transmissions and differentials.

BACKGROUND OF THE INVENTION

Transmissions pose problems for lubricant formulators because of the configuration of the transmission and the metallurgy of the transmission components. Manual transmissions use spur gears which provided pressure and shearing in essentially linear force lines. In other words, the force of shear has only one directional component. This is in contrast to gears used for the driveline which are hypoid gears. In a hypoid gear, the gears mesh in such a way that the shearing force has two directional components. A linear component and a second transverse component across the gear face. The level of extreme pressure protection needed for a transmission is lower than that needed for a hypoid gear assembly.

The transmission requires certain frictional properties from the lubricant to provide the ability of the manual transmission to perform gear changes. For the gear to be changed, the transmission must bring the drive shaft and the gear into position for meshing. The meshing is accomplished by a synchronizer when the synchronizing parts (plate to plate or ring to cone) are reduced to relative zero velocity. If these parts do not obtain zero relative velocity, then a phenomenon known as synchronizer clashing (sometimes referred to as crashing) occurs. Clashing of the synchronizer results when the dynamic coefficient of friction building between the engaging synchronizer parts (plate to plate or ring to cone) falls below a critical minimum value. Below this critical minimum value the synchronizer parts do not attain zero relative velocity and the lockup mechanism (e.g., spline camphers) contacts the rotating member (e.g., cone camphers) resulting in a loud noise (clashing/crashing).

The components of transmissions are typically bronze or brass. These metals are susceptible to corrosion and chemical attack from typical antiwear and extreme pressure agents which contain sulfur, particularly active sulfur. For instance, organic polysulfides which are typically used with lubricants for hypoid gears cause damage to the manual transmission synchronizer components.

It is desirable to provide lubricants which can provide the antiwear protection and viscosity protection for transmissions without harming the components of the transmission. It is especially desirable to provide manual transmission fluids have little, if any, corrosiveness to yellow metal components of transmission fluids.

SUMMARY OF THE INVENTION

This invention relates to a lubricating composition comprising a major amount of an oil of lubricating viscosity, (A) an antiwear improving amount of at least one molybdenum containing composition, (B) at least one phosphorus antiwear or extreme pressure agent, and (C) at least one dispersant, provided that the lubricating composition is free of polysulfurized olefins. The lubricating compositions have improved antiwear properties. When the lubricating composition is used in a manual transmission, the amount of brass wear is reduced.

DESCRIPTION OF THE INVENTION

The term "hydrocarbyl" includes hydrocarbon as well as substantially hydrocarbon groups. Substantially hydrocarbon describes groups which contain heteroatom substituents which do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g., pyridyl, furyl, thienyl, imidazolyl, etc.

In general, no more than about 2, or no more than one, hetero substituent will be present for every ten carbon atoms in the hydrocarbyl group. Typically, there will be no such hetero atom substituents in the hydrocarbyl group. Therefore, the hydrocarbyl group is purely hydrocarbon.

The term polysulfurized olefins refers to olefins which are reacted with sulfur, hydrogen sulfide or a combination thereof to form a reaction product that contain on average more than one sulfur atom per olefins. Typically these products couple two olefins through sulfide linkages. These linkages generally contain from about two to about eight sulfur atoms. These products are generally referred to as polysulfurized olefins. An example of these products is the reaction product of isobutylene, sulfur and hydrogen sulfide under pressure.

In the specification and claims, the term "lubricating composition" refers to the combination of an oil of lubricating viscosity and additives. The percentages by weight are based on the total amount of the additive and the oil of lubricating viscosity.

As described herein, the use of molybdenum containing compositions in combination with specific additives improves the antiwear properties of lubricants, especially brass wear. The molybdenum composition is generally used at a level sufficient to deliver from about 100, or about 125 up to about 900 ppm, or from about 150 up to about 700 ppm, or from about 200 up to about 500 ppm of molybdenum metal to the lubricating composition. Here, as well as elsewhere in the specification, the ratios and range limits may be combined. The molybdenum metal may be in an oil soluble or dispersible form. The molybdenum compositions include a molybdenum containing overbased salt of an acidic organic composition, a molybdenum thiocarbamate, and a molybdenum thiophosphate. In one embodiment, the molybdenum composition is other than a molybdenum containing dispersant, such as a molybdenum containing succinimide.

In one embodiment, the molybdenum composition is a molybdenum dithiocarbamate. The dithiocarbamate may have from two to about six, or about 2 to about 4 hydrocarbyl groups. The dithiocarbamates may have one to about four, or from one to about two dithiocarbamoyl groups. In one embodiment, the dithiocarbamate is a bis-dithiocarbamate. The dithiocarbamates have hydrocarbyl groups independently having from about 1 to about 30, or from about 3 to about 24, or from about 4 to about 18 carbon atoms. The hydrocarbyl groups may be alkyl or aryl groups or combinations of these groups. In one embodiment, the hydrocarbyl groups are all alkyl groups.

The dithiocarbamate may be a simple metal dithiocarbamate, or oxygen or/and sulfur complexes with dithiocarbamoyl moieties. The molybdenum compositions include molybdenum oxysulfide thiocarbamates. Thiocarbamates and their preparation are described below. Molybdenum containing thiocarbamates, including dithiocarbamates are known to those in the art. These materials are described in U.S. Pat. Nos. 4,098,705, 4,259,194, 4,259,195, 4,265,773, 4,272,387, 4,282,822, 4,283,295, 4,369,119, 4,395,423, and 4,402,840. These patents are incorporated by reference for their disclosure of molybdenum containing carbamates and methods of making the same. Examples of commercially available molybdenum containing thiocarbamates include Sakura Lube 500 (20% molybdenum dithiocarbamate from Sakura Chemical), and Molyvan 807 (5% molybdenum dithiocarbamate from Vanderbilt Chemical). The inventors have discovered that the molybdenum containing dithiocarbamates are useful in lubricating compositions which require thermal stability. In one embodiment, the level of molybdenum from the molybdenum containing dithiocarbamate is from about 200 to about 800, or from about 250 to about 600, or from about 300 to about 500 ppm.

In another embodiment, the molybdenum containing composition is a molybdenum thiophosphate. The molybdenum salts of thiophosphorus acids are know those in the art. The thiophosphorus acids, including dithiophosphoric acids, are described below. Molybdenum salts and the methods of their preparation are described in U.S. Pat. Nos. 3,223,625, 3,256,184, 3,400,140, 3,494,866, 3,840,463, and 4,156,099. These patents are hereby incorporated by reference for such disclosure.

In one embodiment, the molybdenum composition is in the form of a molybdenum overbased salt of an acidic organic compound. The molybdenum overbased metal salts are particularly useful in lubricants which require thermal stability. The molybdenum containing overbased salts are characterized by a metal content in excess of that which would be present according to the stoichiometry of the metal and the particular organic compound reacted with the metal. The amount of excess metal is commonly expressed in terms of metal ratio. The term "metal ratio" is the ratio of the total equivalents of the metal to the equivalents of the acidic organic compound. A salt having 4.5 times as much metal as present in a normal salt will have metal excess of 3.5 equivalents per equivalents of organic acid or a ratio of 4.5. The molybdenum containing overbased salts or have a metal ratio from about 1.5, or from about 3. The molybdenum containing overbased salts generally have a metal ratio up to about 40, or up to about 30, or up to about 25. In one embodiment, the metal salts have a metal ratio from about 10, or from about 12 up to about 40, or up to about 30.

The molybdenum containing overbased salts additionally may contain an alkali or alkaline earth metal. Examples of such metals include sodium, potassium, lithium, magnesium, calcium, barium, titanium, manganese, cobalt, nickel, copper, and zinc, or sodium, potassium, calcium, and magnesium. The alkali or alkaline earth metal may typically be present in an amount from about 2% up to about 20%, or from about 4% up to about 18%, or from about 6 to about 14% by weight of the molybdenum containing overbased salts.

The acidic organic compounds used to prepare the molybdenum containing overbased metal salts are generally selected from the group consisting of sulfonic acids, carboxylic acids, phosphorus acids, phenols, and derivatives thereof. In one embodiment, the overbased materials are prepared from sulfonic acids, carboxylic acids, or derivatives of these acids, such as esters, anhydrides, etc. The sulfonic acids are or mono-, di-, and tri-aliphatic hydrocarbon-substituted aromatic sulfonic acids. The hydrocarbon-substituent may be derived from a polyalkene. The polyalkenes include homopolymers and interpolymers of polymerizable olefin monomers having from 2 up to about 16, or from 2 to about 8, or from 2 to about 4 carbon atoms. The olefins may be monoolefins, such as ethylene, propylene, 1-butene, isobutene, and 1-octene; or a polyolefinic monomer, such as 1,3-butadiene and isoprene. In one embodiment, the interpolymer is a homopolymer. An example of a preferred homopolymer is a polybutene, or a polybutene in which about 50% of the polymer is derived from isobutylene. The polyalkenes are prepared by conventional procedures.

The polyalkene is generally characterized as containing from at least about 8, or at least about 15, or at least about 20 carbon atoms. The polyalkene generally contains up to about 40 carbon atoms, or up to about 30 carbon atoms. In one embodiment, the polyalkenes have a $\overline{M}n$ from about 250, or from about 300 up to about 600, or up to about 500, or up to about 400. The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

Examples of sulfonic acids include mahogany sulfonic acids, bright stock sulfonic acids, petroleum sulfonic acids, mono- and polywax-substituted naphthalene sulfonic acids, saturated, hydroxy-substituted, and unsaturated paraffin wax sulfonic acids, wax-substituted benzene or naphthalene sulfonic acids, tetraisobutylene sulfonic acids, tetra-amylene sulfonic acids, dodecylbenzene sulfonic acids, didodecylbenzene sulfonic acids, dinonylbenzene sulfonic acids, sulfonic acids derived by the treatment of at least one of the above-described polyalkenes (or polybutene) with chlorosulfonic acid, and the like.

The sulfonic acids include dodecyl benzene "bottoms" sulfonic acids. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention. The production of sulfonic acids is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

In one embodiment, the acidic organic compound may be a carboxylic acid, or derivative thereof. Suitable carboxylic acids include aliphatic, cycloaliphatic, and aromatic mono- and polybasic carboxylic acids. In one embodiment, the carboxylic acid, or derivative thereof, is an aliphatic acid, or derivative thereof, containing from about 8, or from about 12. The carboxylic acid or derivative thereof generally contains up to about 50, or up to about 25 carbon atoms. Illustrative carboxylic acids and derivatives thereof include 2-ethylhexanoic acid, palmitic acid, stearic acid, oleic acid, linoleic acid, behenic acid, octadecyl-substituted adipic acid, stearyl-benzoic acid, polybutenyl substituted succinic acid or anhydride derived from polybutene ($\overline{M}n$ is from about 200–1500, or from about 300–1500, or from about 800–1200), polypropylene substituted succinic acid or anhydride derived from polypropene ($\overline{M}n$ is from about 200–2000, or from about 300–1500, or from about 800–1200), acids formed by oxidation of petrolatum or of hydrocarbon waxes, commercially available mixtures of two or more carboxylic acids, such as tall oil acids and rosin acids, and mixtures of the above acids, and/or their derivatives.

In one embodiment, the carboxylic acid or derivative thereof is a hydrocarbyl-substituted carboxylic acylating agent. The acylating agent includes halides, esters, anhydrides, etc., or acid, esters, or anhydrides, or anhydrides. In one embodiment, the carboxylic acylating agent is a succinic acylating agent. The acylating agent may be derived from a monocarboxylic or a polycarboxylic acylating agent and one or more of the above described polyalkenes. In one embodiment, the polyalkene is characterized by an $\overline{M}n$ of at least about 400, or at least about 500. Generally, the polyalkene is characterized by an $\overline{M}n$ from about 500 up to about 5000, or from about 700 up to about 2500, or from about 800 up to about 2000, or from about 900 up to about 1500. In one embodiment, the hydrocarbyl group of the carboxylic acylating agent has a $\overline{M}n$ from about 400 to about 1200, or from about 400 to about 800.

In another embodiment, the hydrocarbyl group is derived from polyalkenes having an $\overline{M}n$ from about 1300 up to about 5000, and the $\overline{M}w/\overline{M}n$ value is from about 1.5 up to about 4, or from about 1.8 to about 3.6, or from about 2.5 to about 3.2. The hydrocarbyl-substituted carboxylic acylating agents are prepared by known procedures.

In another embodiment, the acylating agents are prepared by reacting the above described polyalkenes with an excess of maleic anhydride to provide substituted succinic acylating agents wherein the number of succinic groups for each equivalent weight of substituent group is from about 1.3 to about 4.5 succinic groups per equivalent weight of substituent groups. A suitable range is from about 1.4 up to 3.5, or from about 1.5 up to about 2.5 succinic groups per equivalent weight of substituent groups. In this embodiment, the polyalkene has an $\overline{M}n$ from about 1300 to about 5000. A more preferred range for $\overline{M}n$ is from about 1500 to about 2800, and a most preferred range of $\overline{M}n$ is from about 1500 to about 2400.

Carboxylic acids or derivatives thereof (e.g. acylating agents) and their preparation are described in U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. The disclosures of these patents are hereby incorporated by reference.

In another embodiment, the acidic organic compound is an alkyloxyalkylene-acetic acid or alkylphenoxy-acetic acid, or alkylpoly-oxyalkylene-acetic acid or derivatives thereof. Some specific examples of these compounds include: iso-stearylpentaethyleneglycolacetic acid; iso-stearyl-O—$(CH_2CH_2O)_5CH_2CO_2Na$; lauryl-O—$(CH_2CH_2O)_{2.5}CH_2CO_2H$; lauryl-O—$(CH_2CH_2O)_{3.3}CH_2CO_2H$; oleyl-O—$(CH_2CH_2O)_4CH_2CO_2H$; lauryl-O—$(CH_2CH_2O)_{4.5}CH_2CO_2H$; lauryl-O—$(CH_2CH_2O)_{10}CH_2CO_2H$; lauryl-O—$(CH_2—CH_2O)_{16}CH_2CO_2H$; octyl-phenyl-O—$(CH_2CH_2O)_8CH_2CO_2H$; octyl-phenyl-O—$(CH_2CH_2O)_{19}CH_2CO_2H$; 2-octyldecanyl-O—$(CH_2CH_2O)_8CH_2CO_2H$. These acids are available commercially from Sandoz Chemical under the tradename Sandopan acids.

In another embodiment, the acidic organic compound is an aromatic carboxylic acid. A group of useful aromatic carboxylic acids are those of the formula

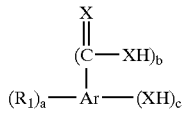

wherein $R_1$ is an aliphatic hydrocarbyl group derived from the above-described olefins or polyalkenes, a is a number in the range of 1 to about 4, usually 1 or 2, Ar is an aromatic group, each X is independently sulfur or oxygen, or oxygen, b is a number in the range from 1 to about 4, usually from 1 to 2, c is a number in the range of zero to about 4, usually 1 to 2, with the proviso that the sum of a, b, and c does not exceed the number of valences of Ar. Examples of aromatic acids include substituted benzoic, phthalic, and salicylic acids. The $R_1$ group is a hydrocarbyl group that is directly bonded to the aromatic group Ar. Examples of $R_1$ groups include substituents derived from the above described polyalkenes.

Ar may be mono- or polynuclear. Mononuclear groups include a phenyl, a pyridyl, or a thienyl. The polynuclear groups may be of the fused type wherein an aromatic nucleus is fused at two points to another nucleus such as found in naphthyl, anthranyl, etc. The polynuclear group can also be of the linked type are linked through bridging linkages such as alkylene, ether, keto, sulfide, disulfide, and polysulfide, containing 3 to about 6 sulfur atoms, linkages. Examples of the aromatic groups include phenyl, phenylene, and naphthalenyl groups.

In one embodiment, the carboxylic acid or derivative thereof is a salicylic acid or derivative thereof. In one embodiment, the salicylic acid or derivative thereof is an aliphatic hydrocarbon-substituted salicylic acid or derivative thereof. The hydrocarbon substituent is generally derived from one or more of the above described polyalkenes.

The above aromatic carboxylic acids are known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791. These patents are incorporated by reference for their disclosure of aromatic carboxylic acids, salts thereof and methods of making the same.

In another embodiment, the acidic organic compound is a phosphorus-containing acid, or derivative thereof. The phosphorus-containing acids, or derivatives thereof, include phosphorus acids, such as phosphoric acid or esters; and thiophosphorus acids or esters, including mono and dithiophosphorus acids or esters. In one embodiment, the phosphorus-containing acid is the reaction product of one or more of the above polyalkenes and a phosphorus sulfide. Useful phosphorus sulfides, include phosphorus pentasulfide, phosphorus sesquisulfide, phosphorus heptasulfide and the like. The reaction of the polyalkene and the phosphorus sulfide generally may occur by simply mixing the two at a temperature above 80° C., usually between 100° C. and 300° C. Generally, the products have a phosphorus content from about 0.05% to about 10%, or from about 0.1% to about 5%. The relative proportions of the phosphorizing agent to the olefin polymer is generally from 0.1 part to 50 parts of the phosphorus sulfide per 100 parts of the polyalkene. The phosphorus-containing acids are described in U.S. Pat. No. 3,232,883 issued to LeSuer. This reference is herein incorporated by reference for its disclosure to the phosphorus-containing acids and methods for preparing the same.

In another embodiment, the acidic organic compound is a phenol. The phenols may be represented by the formula $(R_1)_a$—Ar—$(OH)_b$, wherein $R_1$ is defined above for the aromatic carboxylic acids; Ar is an aromatic group, as defined above; a and b are independently numbers of at least one, the sum of a and b being in the range of two up to the total number of displacable hydrogens on the aromatic nucleus or nuclei of Ar. In one embodiment, a and b are independently numbers in the range of 1 to about 4, or to about 2. In one embodiment, $R_1$ and a are such that there is an average of at least about 8 aliphatic carbon atoms provided by the $R_1$ groups for each phenol compound.

In another embodiment, the molybdenum containing overbased metal salts are borated molybdenum containing overbased metal salts. The molybdenum containing borated overbased metal salts are prepared by reacting one of the below described borated overbased metal salts with a molybdenum containing anion. Alternatively, the molybdenum containing borated overbased metal salts may be prepared by incorporating the boron compound into the initial reaction mixture used to make the molybdenum containing metal salts.

Preparation of the Molybdenum Containing Overbased Composition

In one embodiment, the molybdenum containing overbased compositions are prepared by reacting molybdenum containing anions with an alkali or alkaline earth metal overbased salt of an acidic organic compound. The alkali or alkaline earth metal salts are prepared by reacting an acidic material, described below (typically carbon dioxide), with a mixture comprising an acidic organic compound, such as those described above, a reaction medium comprising at least one inert, organic solvent for the organic material, a stoichiometric excess of the alkali or alkaline earth basic metal compound, typically a metal hydroxide or oxide, and a promoter, including alcoholic and phenolic promoters, such as alcohols having about one to about 12 carbon atoms (such as methanol, ethanol, amyl alcohol, octanol, isopropanol, and mixtures of these), and alkylated phenols (such as heptylphenols, octylphenols, and nonylphenols).

Illustrative of alkali or alkaline earth basic metal compounds include hydroxides, oxides, alkoxides (typically those in which the alkoxy group contains up to 10 and or up to 7 carbon atoms), hydrides and amides of alkali or alkaline earth metals. Useful basic metal compounds include lithium hydroxide, sodium hydroxide, potassium hydroxide, magnesium oxide, calcium hydroxide, calcium oxide, and barium hydroxide. The alkali and alkaline earth metal salts and methods of making the same are described in U.S. Pat. No. 4,627,928. This patent is hereby incorporated by reference for such disclosure. A comprehensive discussion of suitable promoters is found in U.S. Pat. Nos. 2,777,874; 2,695,910; 2,616,904; 3,384,586; and 3,492,231. These patents are incorporated by reference for their disclosure of promoters.

The temperature at which the acidic material is contacted with the remainder of the reaction mass depends to a large measure upon the promoting agent used. With a phenolic promoter, the temperature usually ranges from about 80° C. to about 300° C., and or from about 100° C. to about 200° C. When an alcohol or mercaptan is used as the promoting agent, the temperature usually will not exceed the reflux temperature of the reaction mixture.

Acidic materials, which are reacted with the mixture of the acidic organic compound, the promoter, the metal compound and the reactive medium, are also disclosed in the above cited patents, for example, U.S. Pat. No. 2,616,904. Included within the known group of useful acidic materials are formic acid, acetic acid, nitric acid, boric acid, sulfuric acid, hydrochloric acid, hydrobromic acid, carbamic acid, substituted carbamic acids, etc. Acetic acid is a very useful acidic material. Inorganic acidic compounds such as HCl, $SO_2$, $SO_3$, $CO_2$, $H_2S$, $N_2O_3$, etc., may also be employed as the acidic materials. Preferred acidic materials are $SO_2$, $SO_3$, carbon dioxide and acetic acid, or carbon dioxide.

The methods for preparing the overbased materials are well known in the prior art and are disclosed, for example, in the following U.S. Pat. Nos. 2,616,904; 2,616,905; 2,616,906; 3,242,080; 3,250,710; 3,256,186; 3,274,135; 3,492,231; and 4,230,586. These patents disclose processes, materials which can be overbased, suitable metal bases, promoters, and acidic materials. These patents are incorporated herein by reference for these disclosures. Other descriptions of basic sulfonate salts and techniques for making them can be found in the following U.S. Pat. Nos. 2,174,110; 2,202,781; 2,239,974; 2,319,121; 2,337,552; 3,488,284; 3,595,790; and 3,798,012. These are hereby incorporated by reference for their disclosures in this regard.

As described above the alkali or alkaline earth overbased compositions may be reacted with molybdenum containing anions to form the molybdenum containing overbased metal salts of acidic organic compounds. The molybdenum anions are delivered as molybdic acid or ammonium or alkali metal salts of molybdic acid including $(NH_4)_6Mo_7O_{24}$, $(NH_4)_2Mo_2O_7$ and various hydrates, such as $(NH_4)_6Mo_7O_{24}4H_2O$. In one embodiment, the reaction is facilitated by the use of a peptizing agent. Peptizing agents include one or more of the dispersants described herein. This process and the molybdenum containing overbased compositions are described in U.S. Pat. No. 3,541,014 (LeSuer). This patent is incorporated by reference for this disclosure.

In another embodiment, the molybdenum containing overbased compositions are prepared by reacting the components used in the overbasing process in the presence of at least one organic molybdenum complex. The molybdenum containing organic complex is or an amine-molybdenum complex, which are typically prepared by a reaction of an acidic and organic molybdenum compound with an amine. The molybdenum compounds include molybdic acid, alkali metal molybdates, sodium hydrogen molybdate, ammonium molybdate, $MoOCl_4$, and molybdenum trioxide. Sodium molybdate and ammonium molybdate are preferred. The amine-molybdenum complex is in general prepared in an aqueous medium. The amine is added to an aqueous solution of an inorganic molybdenum compound. The reaction mixture is kept at a temperature between about 20° and about 100° C., or between about 50° and about 90° C., for about 0.5 to about 3 hours after the addition of the amine. The amount of acid necessary to neutralize the reaction mixture is added before or after the introduction of the amine. A strong mineral acid is used, or sulfuric acid. The amine-molybdenum complex precipitates. It is recovered by filtering off, washed with water and dried, if appropriate. The complex has a solid or pasty appearance, depending on the type of amine used. Its color varies from white to blue. It is virtually insoluble or very sparingly soluble in hydrocarbons.

The atomic ratio of nitrogen to molybdenum in the complex is in general from about 0.25 to about 4, or from about 0.5 to about 2. The molybdenum content of the complex varies depending on the nature of the amine used: it is between about 10% and about 45%. Among the organic molybdenum complexes, the complexes with oxygen-containing compounds may also be used. The 1,2-, 1,3- and 1,4-glycols are very particularly suitable. Ethylene glycol and propylene glycol are or used. Amongst the polyols, are glycerol and trimethylolpropane.

Some amines, or polyamines which are alkoxylated, or with ethylene oxide or propylene oxide, are also suitable. The derivatives of diethanolamine or of triethanolamine may be mentioned.

The preparation of the molybdenum containing overbased compositions can be carried out by heating the oxygen-containing compound at about 90°–100° C. in the presence of a molybdenum compound, such as ammonium molybdate. The water produced by the reaction is removed using a stream of nitrogen. The molybdenum content of the complexes obtained varies between about 7% and about 50% by weight, depending on the degree to which unreacted oxygen-containing compound has been removed.

The organic molybdenum complex can be sulfurized, for example, by the action of hydrogen sulfide ($H_2S$) on a suspension of the complex in an aromatic solvent such as xylene or toluene, at a temperature of between about 40° C. and about 100° C. From the introduction of hydrogen sulfide, the color of the suspension changes from blue-green to orange, and then to red. The amount of hydrogen sulfide introduced is such that the atomic ratio of sulfur to molybdenum is between about 1 and about 3.

The overbased products containing molybdenum, obtained according to the invention, are clear and stable and colored brown in the case of the sulfonates, deep green in the case of the phenolates and black in the case of the salicylates. The color is generally red for the overbased detergents in the presence of a sulfurized complex. The proportion of molybdenum incorporated in the additive is close to 100%, higher than the proportions obtained during incorporation of inorganic molybdenum derivatives. The additive contains from about 0.1% to about 10% by weight, or from about 1% to about 4% of molybdenum. The overbased additives according to the invention are soluble or dispersible in hydrocarbons. The molybdenum containing overbased salts prepared with molybdenum amine complexes are described in U.S. Pat. No. 5,143,633. This patent is incorporated by reference for its description of the molybdenum containing overbased salts and methods of making the same.

The following Examples relate to molybdenum containing overbased compositions and methods of making the same. In the Examples, as well as elsewhere in the specification and claims, unless the context indicates otherwise, the parts and percentages are by weight, the temperature is degrees Celsius, and the pressure is atmospheric. In the examples the basicity of these overbased additives is characterized by their neutralization number or AV (alkali value) is expressed in mg of KOH per gram of product. It is determined by titration with aid of a strong acid in accordance with the standard ASTM D-2896.

EXAMPLE M-1

(a) A solution of 41.17 g of sodium molybdate $Na_2MoO_4 2.H_2O$ in 100 ml of water is prepared in a reactor fitted with a temperature control and a stirrer device. The mixture is acidified by adding 55.6 g of 30% $H_2SO_4$ and then heated to 60° C. This is followed by the addition of 21 g of Dinoram C from CECA SA. Dinoram C corresponds to the formula R—N—H—$(CH_2)_3$—$NH_2$, where R is a mixture of straight-chain saturated alkyl radicals containing 60% of $C_{12}$, 20% of $C_{14}$, 10% of $C_{16}$ and 5% of $C_{18}$. The blue precipitate is recovered by filtering off and then washing with water and with methanol before drying. Finally, 47.1 g of blue solid containing 32.6% of molybdenum and 4.4% of nitrogen are recovered.

(b) A reaction vessel is charged with 520 ml of xylene and 30 grams of the Dinoram C/molybdenum complex from above. The mixture is stirred. Then, 131.8 g of alkylxylenesulfonic acid having $C_{16-18}$ straight-chain alkyl chain and a molecular weight of 430 and containing 96% of active substance, 168 g of diluent oil 100 Neutral solvent, 113.24 g of slaked lime of 96% purity and 48 ml of methanol are added to the mixture. After neutralization of the sulfonic acid with the lime, which, if appropriate, can be carried out by heating the reaction mixture at 60° C. for 30 minutes, 55.2 g of carbon dioxide gas are then introduced into the mixture which is kept at a temperature of 42° C.

After carbonation and removal of water and methanol under partial vacuum, the solid residues are removed by centrifuging. After evaporating off the solvent, 448 g of molybdenum-containing superbasic sulfonate are recovered; neutralization number=300, its calcium contents is 11.7% and its molybdenum content 2.17%. It is stable on dilution in lubricant oils.

EXAMPLE M-2

(a) A dispersion of 20 g of the complex prepared in Example M-1 in 200 ml of xylene is prepared in a 250 ml reactor fitted with a temperature control, a stirrer and a gas bubbling system. 6.7 g of $H_2S$ are injected into the dispersion kept at 80° C.; the deep red solid collected after removal of the solvent contains 28.4% of molybdenum, 3.8% of nitrogen and 23.7% of sulfur.

(b) The procedure is as in Example M-1, but 28 g of sulphurized Dinoram C/molybdenum complex (Example M-2(a) are suspended in 520 ml of xylene, this being carried out before the introduction of the other reactants. The sequence of operations is identical to that of Example M-1 except that the residues are removed by centrifuging. A molybdenum-containing superbasic sulphonate is collected; AV=304. The molybdenum, sulphur and calcium contents are, respectively, 1.63, 3.4 and 11.7%. The product obtained has a brown-red color and it is stable on dilution in lubricant oils.

EXAMPLE M-3

(a) A 2-ethylhexylamine/molybdenum complex is prepared as follows: The procedure is as in Example M-1 but 9.9 g of 98% 2-ethylhexylamine are added at 60° C. before heating and acidification and are introduced in the course of 20 minutes into an aqueous solution containing 15.44 g of sodium molybdate and kept at 60° C. After heating at 60° C. for 45 minutes, the mixture is acidified with 23.1 g of 30% sulfuric acid, before washing and drying the product. The latter is in the form of a white solid containing 36.8% of molybdenum and 4.38% of nitrogen.

(b) The procedure is as in Example M-1, but 28 g of the 2-ethylhexylamine complex prepared in Example M-3(a) are suspended in 520 ml of xylene before the introduction of the other reactants. The procedure is the same as in Example M-1 except that the residues are removed by centrifuging. A brown product of AV=353 is collected. The calcium and molybdenum contents are, respectively, 12.2 and 1.97%. The stability on dilution in lubricant oils is perfect.

EXAMPLE M-4

The procedure is as in Example M-1(b), but 600 milliliters of xylene, 132 grams of didodecylbenzenesulfonic acid having a molecular weight of 520 and containing 70% of active substance 30 grams of the complex prepared in Example M-1(a), 104 grams of slaked lime, 52 milliliters of methanol, 4.4 milliliters of ammonia and 90 grams of diluent oil are introduced successively into the reactor. The product collected is brown, clear and stable in oils. The calcium and molybdenum contents are, respectively, 10 and 2.35%.

The procedure is as in Example M-1, but 30 grams of the complex prepared in Example M-1 (a) are introduced into 520 milliliters of toluene before the addition of other reactants. The sequence of operations is identical to that of Example 1 except that 52.7 grams of $CO_2$ are introduced during the carbonation. After centrifuging, 448 grams of molybdenum-containing superbaseic sulfonate are recovered. AV=298. The calcium and molybdenum contents are, respectively, 11.7% and 2.1%.

EXAMPLE M-5

(A) A mixture of 44 parts (all parts refer to parts by weight) of the product of Example M-4(b), 10 parts mineral oil, and 24 parts of the reaction product of polyisobutene ($\overline{M}n$=750)-substituted succinic anhydride with a commercial mixture of polyethylene polyamines having an average composition corresponding to that of tetraethylene pentamine (reacted in a ratio of equivalents of 1:1 according to the procedure of U.S. Pat. No. 3,172,892, e.g., Example 12 thereof is prepared and heated to about 75° C. over a 1.5 hour period. The weight ratio of peptizing agent to overbased material is 5:95. To this solution there is added 520 parts of an aqueous ammonium molybdate solution previously prepared by mixing 265 parts by weight of water and 265 parts by weight of a commercial ammonium molybdate (ammonium dimolybdate sold by the Climax Molybdenum Company having a composition corresponding to the formula $(NH_4)_2Mo_2O_7$ containing about 56.5% by weight molybdenum) over a 1.5 hour period while maintaining a temperature at about 70–80° C. resulting in a molar ratio of barium to molybdenum of 1:1.53. The resulting reaction mass is heated under reflux conditions at about 150° C. for about 8.8 hours. Subsequently, the mixture is blown with nitrogen at about 5 parts per hour while maintaining the temperature at about 150° C. for an additional 1.3 hours. The nitrogen blowing is thereafter ceased, the mixture is maintained at about 150° C. for an additional hour and the entire reaction mass is filtered. The filtrate contains the desired molybdenum-containing complex and is characterized by having 19.67% by weight molybdenum and 21.81% by weight barium.

(B) To a mixture of 2.285 grams of the overbased product of Example M-4(b) and 125 grams of the peptizing agent referred to above (Example M-5(a)), there is added slowly over three hours 2600 grams of an aqueous solution of ammonium paramolybdate tetrahydrate (prepared by mixing 1300 grams of the molybdate and 1300 grams of water) while maintaining a temperature slightly above 70° C. The weight ratio of peptizing agent to overbased product is 5:95 and the barium to molybdenum molar ratio of 1:1.47. Ammonia, carbon dioxide, and water are evolved during the ensuing reaction. Thereafter, nitrogen is bubbled through the reaction mass to remove water and gases during which time the product is heated to 170° C. for four hours. Then a commercial filter aid is added and the mass is filtered. The filtrate weighs 2.710 grams and contains 20.2% by weight molybdenum, 21.6% by weight barium, and 25.3% by weight oil.

Phosphorus Compounds

As described above, the molybdenum containing composition salts are used in combination at least one phosphorus containing antiwear/extreme pressure agent selected from a metal thiophosphate, a phosphoric acid ester or salt thereof, or a phosphorus-containing carboxylic acid, ester, ether, or amide, and a phosphite. The phosphorus containing agents are typically present in the lubricants and functional fluids at a level of up to about 20% by weight, or up to about 10% by weight, based on the total weight of the lubricant, or functional fluid. Typically, the phosphorus containing antiwear/extreme pressure agent is present at a level from about 0.1%, or from about 0.5%, or from about 0.8% by weight. In one embodiment, the phosphorus containing antiwear/extreme pressure agent is present in an amount up to about 10%, or up to about 3%, or up to about 2% by weight. Typically, the phosphorus antiwear agent is present at a level from about 0.1% to about 5%, or from about 0.3% or to about 4%, or from about 0.5% to about 3%, or from 0.7% to about 2% by weight in the lubricating composition. The total phosphorus is usually less than about 0.1%, or less than 0.09%, or less than about 0.08% by weight. In another embodiment, the phosphorus antiwear agent is present at an amount from about 0.05% to about 1%, or from about 0.2% to about 0.8%, or from about 0.3% to about 0.7% by weight of the lubricating composition.

Examples of phosphorus containing antiwear/extreme pressure agents include a metal thiophosphate; a phosphoric acid ester or salt thereof; a phosphorus-containing carboxylic acid, ester, ether, or amide; and a phosphite. The phosphorus acids include the phosphoric, phosphonic, phosphinic and thiophosphoric acids including dithiophosphoric acid as well as the monothiophosphoric acid, thiophosphinic and thiophosphonic acids.

In one embodiment, the phosphorus containing antiwear/extreme pressure agent is a phosphorus acid ester prepared by reacting one or more phosphorus acid or anhydride with an alcohol containing from one, or about 3 carbon atoms. The alcohol generally contains up to about 30, or up to about 24, or up to about 12 carbon atoms. The phosphorus acid or anhydride is generally an inorganic phosphorus reagent, such as phosphorus pentoxide, phosphorus trioxide, phosphorus tetroxide, phosphorus acid, phosphorus halide, lower phosphorus esters, or a phosphorus sulfide, including phosphorus pentasulfide, and the like. Examples of phosphorus acids or anhydrides include phosphorus pentoxide, phosphorus pentasulfide and phosphorus trichloride. Lower phosphorus acid esters generally contain from 1 to about 7 carbon atoms in each ester group. The phosphorus acid ester may be a mono-, di- or triphosphoric acid ester. Alcohols used to prepare the phosphorus acid esters include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography)); and Alfol 22+ alcohols ($C_{18}$–$C_{28}$ primary alcohols containing primarily $C_{22}$ alcohols). Alfol alcohols are available from Continental Oil Company.

Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from about $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example of these phosphorus acid esters is tricresylphosphate.

In another embodiment, the phosphorus antiwear/extreme pressure agent is a thiophosphorus acid ester or salt thereof. The thiophosphorus acid ester may be prepared by reacting a phosphorus sulfide, such as those described above, with an alcohol, such as those described above. The thiophosphorus acid esters may be mono- or dithiophosphorus acid esters. Thiophosphorus acid esters are also referred to generally as thiophosphoric acids.

In one embodiment, the phosphorus acid ester is a monothiophosphoric acid ester or a monothiophosphate. Monothiophosphates may be prepared by the reaction of a sulfur source with a dihydrocarbyl phosphite. The sulfur source may for instance be elemental sulfur. The sulfur source may also be a monosulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638, which are incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate.

In another embodiment, the phosphorus antiwear/extreme pressure agent is a dithiophosphoric acid or phosphorodithioic acid. The dithiophosphoric acid may be represented by the formula $(RO)_2PSSH$ wherein each R is independently a hydrocarbyl group containing from about 3 to about 30 carbon atoms. R generally contains up to about 18, or to about 12, or to about 8 carbon atoms. Examples R include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl R groups include butylphenyl, amylphenyl, heptylphenyl, etc. Examples of mixtures of R groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

In one embodiment, the dithiophosphoric acid may be reacted with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols having from 1 to about 12, or about 2 to about 6, or 2 or 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. Nos. 3,197,405 and 3,544,465 which are incorporated herein by reference for their disclosure to these.

The following Examples B-1 and B-2 exemplify the preparation of useful phosphorus acid esters.

EXAMPLE B-1

Phosphorus pentoxide (64 grams) is added at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and an acid number of 87 (bromophenol blue).

EXAMPLE B-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and an acid number of 126 (bromophenol blue).

Acidic phosphoric acid esters may be reacted with ammonia, an amine compound or a metallic base to form an ammonium or metal salt. The salts may be formed separately and then the salt of the phosphorus acid ester may be added to the lubricating composition. Alternately, the salts may also be formed in situ when the acidic phosphorus acid ester is blended with other components to form a fully formulated lubricating composition.

The amine salts of the phosphorus acid esters may be formed from ammonia, or an amine, including monoamines and polyamines. The amines may be primary amines, secondary amines or tertiary amines. In one embodiment, the amines are one or more of the amines described above for preparing the dithiocarbamates. Useful amines include those amines disclosed in U.S. Pat. No. 4,234,435 at Col. 21, line 4 to Col. 27, line 50, these passages being incorporated herein by reference.

The monoamines generally contain from 1 up to about 24 carbon atoms, or up to about 12, or up to about 6 carbon atoms. Examples of monoamines include methylamine, ethylamine, propylamine, butylamine, octylamine, and dodecylamine, dimethylamine, diethylamine, dipropylamine, dibutylamine, methyl butylamine, ethyl hexylamine, trimethylamine, tributylamine, methyl diethylamine, ethyl dibutylamine, etc.

In one embodiment, the amine may be a fatty ($C_{4-30}$) amine which include n-hexylamine, n-octylamine, n-decylamine, n-dodecylamine, n-tetradecylamine, n-hexadecylamine, n-octadecylamine, oleylamine, etc. Also useful fatty amines include commercially available fatty amines such as "Armeen" amines (products available from Armak Chemicals, Chicago, Ill.), such as Armak's Armeen-C, Armeen-O, Armeen-OL, Armeen-T, Armeen-HT, Armeen S and Armeen SD, wherein the letter designation relates to the fatty group, such as cocoa, oleyl, tallow, or soya groups.

Other useful amines include primary ether amines, such as those represented by the formula, $R''(OR')_xNH_2$, wherein R' is a divalent alkylene group having about 2 to about 6 carbon atoms, x is a number from one to about 150 (or one), and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine may be a hydroxyamine. Typically, the hydroxyamines are primary, secondary or tertiary alkanol amines or mixtures thereof. Such amines can be represented by the formulae: $H_2$—N—R'—OH, $H(R'_1)$N—R'—OH, and $(R'_1)_2$—N—R'—OH, wherein each $R'_1$ is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group such as an ethylene, propylene, 1,2-butylene, 1,2-octadecylene, etc. group. Where two R'1 groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyidiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with afore described amines and may be represented by the formulae: $H_2N$—$(R'O)_x$—H, $H(R'_1)$—$N(R'O)_x$—H, and $(R'_1)_2$—N—$(R'O)_x$—H, wherein x is a number from about 2 to about 15 and $R_1$ and R' are as described above. $R'_1$ may also be a hydroxypoly(hydrocarbyloxy) group.

The amines may be hydroxyamines, such as those represented by the formula

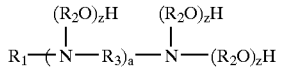

wherein $R_1$ is a hydrocarbyl group generally containing from about 6 to about 30 carbon atoms; $R_2$ and each $R_3$ is independently an alkylene group containing up to about 5 carbon atoms, or an ethylene or propylene group; a is zero or one; and each z is independently a number from zero to about 10, with the proviso that at least one z is at least one. These hydroxyamines can be prepared by techniques well known in the art and many such hydroxyamines are commercially available. The hydroxy amines include mixtures of amines such as obtained by the hydrolysis of fatty oils (e.g., tallow oils, sperm oils, coconut oils, etc.). Specific examples of fatty amines, containing from about 6 to about 30 carbon atoms, include saturated as well as unsaturated aliphatic amines, such as octyl amine, decyl amine, lauryl amine, stearyl amine, oleyl amine, dodecyl amine, and octadecyl amine.

Useful hydroxyamines wherein a in the above formula is zero include 2-hydroxyethyl, hexylamine; 2-hydroxyethyloctylamine; 2-hydroxyethyl, pentadecylamine; 2-hydroxyethyl, oleylamine; 2-hydroxyethyl, soyamine; bis(2-hydroxyethyl) hexylamine; bis(2-hydroxyethyl)oleylamine; and mixtures thereof. Also included are the comparable members wherein in the above formula at least one of z is at least 2, as for example, 2-hydroxyethoxyethyl, hexylamine.

A number of hydroxyamines wherein a in the above formula is zero are available from the Armak Chemical Division of Akzona, Inc., Chicago, Ill., under the general trade designations "Ethomeen" and "Propomeen". Specific examples of such products include: Ethomeen C/15 which is an ethylene oxide condensate of a coco alkyl amine containing about 5 moles of ethylene oxide; Ethomeen C/20 and C/25 which are ethylene oxide condensation products from coco alkyl amine containing about 10 and 15 moles of ethylene oxide, respectively; Ethomeen O/12 which is an ethylene oxide condensation product of oleylamine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleylamine with 2 moles propylene oxide.

Commercially available examples of alkoxylated amines where a in the above formula is one include Ethoduomeen T/13 and T/20 which are ethylene oxide condensation products of N-tallow trimethylenediamine containing 3 and 10 moles of ethylene oxide per mole of diamine, respectively.

The amine may also be a polyamine. The polyamines include alkoxylated diamines, fatty diamines, alkylenepolyamines, hydroxy containing polyamines, condensed polyamines and heterocyclic polyamines. Commercially available examples of alkoxylated diamines include those amines where a in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the amine is an alkylenepolyamine. Alkylenepolyamines are represented by the formula $HR_1N$-(Alkylene-N)$_n$—$(R_1)_2$, wherein each $R_1$ is independently hydrogen; or an aliphatic or hydroxy-substituted aliphatic group of up to about 30 carbon atoms; $\overline{M}n$ is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, $R_1$ is defined the same as $R'_1$ above. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the afore described polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentamine and 76.61% pentaethylenehexamine and higher analogs. These alkylenepolyamine bottoms include cyclic condensation products, such as piperazine, and higher analogs of diethylenetriamine, triethylenetetramine and the like. These alkylenepolyamine bottoms may be reacted solely with the acylating agent or they may be used with other amines, polyamines, or mixtures thereof.

Another useful polyamine is a condensation reaction between at least one hydroxy compound with at least one polyamine reactant containing at least one primary or secondary amino group. The hydroxy compounds are or polyhydric alcohols or polyhydric amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20, or from two to about four carbon atoms. Examples of polyhydric amines include tri-(hydroxypropyl)amine, tris-(hydroxymethyl)amino methane, 2-amino-2-methyl-1,3-propanediol, N,N,N',N'-tetrakis (2-hydroxypropyl) ethylenediamine, and N,N,N',N'-tetrakis (2-hydroxyethyl) ethylenediamine, or tris(hydroxymethyl) aminomethane (THAM).

Polyamines which may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO 86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris (hydroxymethyl)aminomethane (THAM).

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The preferred polyoxyalkylene polyamines include the polyoxyethylene and polyoxypropylene diamines and the polyoxypropylene triamines. The polyoxyalkylene polyamines are commercially available and may be obtained, for example, from the Jefferson Chemical Company, Inc. under the trade name "Jeffamines D-230, D400, D-1000, D-2000, T-403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N(diethanol)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxides in a 1.1 to 1.2 molar ratio. Reactant ratios and temperatures for carrying out such reactions are known to those skilled in the art. Specific examples of hydroxy-containing polyamines include N-(2-hydroxyethyl) ethylenediamine, N,N'-bis(2-hydroxyethyl)-ethylenediamine, 1-(2-hydroxyethyl)-piperazine, mono (hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above described polyamines are also useful.

In another embodiment, the amine is a heterocyclic amine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic amines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, sulfates, borates, or the like. The metals of the metal base include Group IA, IIA, IIB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably the metal is magnesium, calcium, manganese or zinc. Examples of metal compounds which may be reacted with the phosphorus acid include zinc hydroxide, zinc oxide, copper hydroxide, copper oxide, etc.

In one embodiment, phosphorus containing antiwear/extreme pressure agent is a metal thiophosphate, preferably a metal dithiophosphate. The metal thiophosphate is prepared by means known to those in the art. Examples of metal dithiophosphates include zinc isopropyl, methylamyl dithiophosphate, zinc isopropyl isooctyl dithiophosphate, barium di(nonyl) dithiophosphate, zinc di(cyclohexyl) dithiophosphate, zinc di(isobutyl) dithiophosphate, calcium di(hexyl) dithiophosphate, zinc isobutyl isoamyl dithiophosphate, and zinc isopropyl secondary-butyl dithiophosphate.

The following Examples B-3 to B-6 exemplify the preparation of useful phosphorus acid ester salts.

EXAMPLE B-3

A reaction vessel is charged with 217 grams of the filtrate from Example B-1. A commercial aliphatic primary amine (66 grams), having an average molecular weight of 191 in which the aliphatic radical is a mixture of tertiary alkyl radicals containing from 11 to 14 carbon atom, is added over a period of 20 minutes at 25–60° C. The resulting product has a phosphorus content of 10.2% by weight, a nitrogen content of 1.5% by weight, and an acid number of 26.3.

EXAMPLE B-4

Following the procedures of Examples B-1 and B-3, 1320 parts of the product described in B-1 was reacted with 584 parts of the amine of B-3. The final product has 8.4% phosphorus and 10% sulfur.

EXAMPLE B-5

The filtrate of Example B-2 (1752 grams) is mixed at 25–82° C. with 764 grams of the aliphatic primary amine used in of Example B-3. The resulting product has 9.9% phosphorus, 2.7% nitrogen, and 12.6% sulfur.

EXAMPLE B-6

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60–70° C. under a pressure of 30 mm Hg. The resulting product mixture is filtered using a diatomaceous earth. The filtrate has 8.6% zinc and 7.0% phosphorus.

EXAMPLE B-7

Alfol 8–10 (2628 parts, 18 moles) is heated to a temperature of about 45° C. whereupon 852 parts (6 moles) of phosphorus pentoxide are added over a period of 45 minutes while maintaining the reaction temperature between about 45–65° C. The mixture is stirred an additional 0.5 hour at this temperature, and is there-after heated at 70° C. for about 2–3 hours. Primene 81-R (2362 parts, 12.6 moles) is added dropwise to the reaction mixture while maintaining the temperature between about 30–50° C. When all of the amine has been added, the reaction mixture is filtered through a filter aid, and the filtrate is the desired amine salt containing 7.4% phosphorus (theory, 7.1%).

EXAMPLE B-8

Phosphorus pentoxide (208 grams) is added to the product prepared by reacting 280 grams of propylene oxide with 1184 grams of O,O'-di-isobutyl phosphorodithioic acid at 30–60° C. The addition is made at a temperature of 50–60° C. and the resulting mixture is then heated to 80° C. and held at that temperature for 2 hours. The commercial aliphatic primary amine identified in Example B-3 (384 grams) is added to the mixture, while the temperature is maintained in the range of 30–60° C. The reaction mixture is filtered through diatomaceous earth. The filtrate has 9.3% phosphorus, 11.4% sulfur, 2.5% nitrogen, and a base number of 6.9 (bromophenol blue indicator).

In another embodiment, the phosphorus antiwear/extreme pressure agent is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula RCOOH, wherein R is an aliphatic or alicyclic hydrocarbyl group preferably free from acetylenic unsaturation. R generally contains from about 2, or from about 4 carbon atoms. R generally contains up to about 40, or up to about 24, or to up about 12 carbon atoms. In one embodiment, R contains from 4, or from about 6 up to about 12, or up to about 8 carbon atoms. In one embodiment, R is an alkyl group. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. A preferred carboxylic acid is 2-ethylhexanoic acid.

The metal salts may be prepared by merely blending a metal salt of a dithiophosphoric acid with a metal salt of a carboxylic acid in the desired ratio. The ratio of equivalents of dithiophosphoric acid to carboxylic acid is from about 0.5 up to about 400 to 1. The ratio may be from 0.5 up to about 200, or up to about 100, or up to about 50, or up to about 20 to 1. In one embodiment, the ratio is from 0.5 up to about 4.5 to one, or from about 2.5 up to about 4.25 to one. For this purpose, the equivalent weight of a dithiophosphoric acid is its molecular weight divided by the number of —PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., or up to about 125° C. U.S. Pat. Nos. 4,308,154 and 4,417,990 describe procedures for preparing these metal salts and disclose a number of examples of such metal salts. These patents are hereby incorporated by reference for those disclosures.

In one embodiment, the phosphorus containing antiwear/extreme pressure agent is a phosphorus containing amide. The phosphorus containing amides are prepared by the reaction of one of the above described phosphorus acids, or a dithiophosphoric acid, with an unsaturated amide. Examples of unsaturated amides include acrylamide, N,N'-methylene bis(acrylamide), methacrylamide, crotonamide, and the like. In one embodiment, the dithiocarbamate containing composition is derived from the reaction product of a diamylamine or dibutylamine with carbon disulfide which forms a dithiocarbamic acid or a salt which is ultimately reacted with a acrylamide. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374 which are incorporated by reference for their disclosures of phosphorus amides and their preparation.

In one embodiment, the phosphorus antiwear/extreme pressure agent is a phosphorus containing carboxylic ester. The phosphorus containing carboxylic esters are prepared by reaction of one of the above-described phosphorus acids, preferably a dithiophosphoric acid, and one of the unsaturated carboxylic acids or esters described herein. If the carboxylic acid is used, the ester may then be formed by subsequent reaction of the phosphoric acid-unsaturated carboxylic acid adduct with an alcohol, such as those described herein.

In one embodiment, the phosphorus containing antiwear/extreme pressure agent is a reaction product of a phosphorus acid, preferably a dithiophosphoric acid, and a vinyl ethers. The vinyl ether is represented by the formula $R_1$—CH═CH—$OR_2$ wherein $R_1$ is independently hydrogen or a hydrocarbyl group having from 1 up to about 30, or up to about 24, or up to about 12 carbon atoms. $R_2$ is a hydrocarbyl group defined the same as $R_1$. Examples of vinyl ethers include methyl vinyl ether, propyl vinyl ether, 2-ethylhexyl vinyl ether and the like.

As described above the lubricating compositions and concentrates contain at least one phosphite. The phosphite may be a di- or trihydrocarbyl phosphite. Preferably each hydrocarbyl group contains from 1 to about 24 carbon atoms, or from 1 to about 18 carbon atoms, or from about 2 to about 8 carbon atoms. Each hydrocarbyl group may be independently alkyl, alkenyl, or aryl. When the hydrocarbyl group is an aryl group, then it contains at least about 6 carbon atoms; or about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, or butyl, oleyl or phenyl and or butyl or oleyl. One method of preparing phosphites includes reacting a lower ($C_{1-8}$) Phosphites and their preparation are known and many phosphites are available commercially. Particularly useful phosphites are dibutyl hydrogen phosphite, dioleyl hydrogen phosphite, di($C_{1418}$) hydrogen phosphite, and triphenyl phosphite.

Dispersants

Together with the molybdenum compounds and the phosphorus compounds, the lubricating compositions contain a dispersant. In one embodiment, the dispersants are selected from (a) acylated nitrogen dispersants, (b) hydrocarbyl substituted amines, (c) carboxylic ester dispersants, (d) Mannich dispersants, and (e) mixtures thereof. The dispersant are generally present in an amount from about 0.1% to about 5%, or from about 0.2% to about 3%, or from about 0.3% to about 0.8% by weight. In one embodiment, the dispersants are present in an amount of less than 3%, or less than 2%, or less than 1.5%, or less than 1% by weight.

The acylated nitrogen dispersants include reaction products of one or more carboxylic acylating agents such as the hydrocarbyl substituted carboxylic acylating agents and an amine. In one embodiment, the hydrocarbyl groups are derived from one or more of polyalkenes. The polyalkene includes homopolymers and interpolymers of polymerizable olefins or a polyolefinic monomer, preferably diolefinic monomer, such 1,3-butadiene and isoprene. The olefins are described above. In one embodiment, the interpolymer is a homopolymer. An example of a preferred homopolymer is a polybutene, or a polybutene in which about 50% of the polymer is derived from isobutylene. The polyalkenes are prepared by conventional procedures.

The polyalkene is generally, characterized as containing from at least about 8 carbon atoms up to about 300, or from about 30 up to about 200, or from about 35 up to about 100 carbon atoms. In one embodiment, the polyalkene is characterized by an $\overline{M}n$ (number average molecular weight) greater than about 400, or greater than about 500. Generally, the polyalkene is characterized by an $\overline{M}n$ from about 500 up to about 5000, or from about 700 up to about 2500, or from about 800 up to about 2000, or from about 900 up to about 1500. In another embodiment, the polyalkene has a $\overline{M}n$ up to about 1300, or up to about 1200.

Number average molecular weight, as well as weight average molecular weight and the entire molecular weight distribution of the polymers, are provided by Gel permeation chromatography (GPC). For purpose of this invention a series of fractionated polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In another embodiment, the polyalkenes have a $\overline{M}n$ from about 1300 up to about 5000, or from about 1500 up to about 4500, or from about 1700 up to about 3000. The polyalkenes also generally have a $\overline{M}w/\overline{M}n$ from about 1.5 to about 4, or from about 1.8 to about 3.6, or from about 2.5 to about 3.2. The hydrocarbyl substituted carboxylic acylating agents are described in U.S. Pat. No. 4,234,435, the disclosure of which is hereby incorporated by reference.

In another embodiment, the acylating agents are prepared by reacting one or more of polyalkene with an excess of maleic anhydride to provide substituted succinic acylating agents wherein the number of succinic groups for each equivalent weight of substituent group, i.e., polyalkenyl group, is at least 1.3. The maximum number will generally not exceed 4.5. A suitable range is from about 1.4 to 3.5 and or from about 1.4 to about 2.5 succinic groups per equivalent weight of substituent groups.

The above-described carboxylic acylating agents are reacted with amines to form the acylated nitrogen dispersants.

Acylated nitrogen dispersants and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents is hereby incorporated by reference.

The dispersant may also be derived from hydrocarbyl-substituted amines. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Typically, hydrocarbyl substituted amines are prepared by reacting olefins and olefin polymers (polyalkenes) with amines (mono- or polyamines). The polyalkene may be any of the polyalkenes described above. The amines may be any of the amines described above. Examples of hydrocarbyl substituted amines include poly(propylene)amine; N,N-dimethyl-N-poly(ethylene/propylene)amine, (50:50 mole ratio of monomers); polybutene amine; N,N-di (hydroxyethyl)-N-polybutene amine; N-(2-hydroxypropyl)-N-polybutene amine; N-polybutene-aniline; N-polybutenemorpholine; -poly(butene)ethylenediamine; -poly(propylene)trimethylenediamine; -poly(butene) diethylenetriamine; N',N'-poly(butene) tetraethylenepentamine; N,N-dimethyl-N'-poly(propylene)-1,3-propylenediamine and the like.

In another embodiment, the dispersant may also be derived from a carboxylic ester dispersant. The carboxylic ester dispersant is prepared by reacting at least one of the above hydrocarbyl-substituted carboxylic acylating agents with at least one organic hydroxy compound and optionally an amine. In another embodiment, the carboxylic ester dispersant is prepared by reacting the acylating agent with at least one of the above-described hydroxyamine.

The organic hydroxy compound includes compounds of the general formula $R''(OH)_m$ wherein R" is a monovalent or polyvalent organic group joined to the —OH groups through a carbon bond, and m is an integer of from 1 to about 10 wherein the hydrocarbyl group contains at least about 8 aliphatic carbon atoms. The hydroxy compounds may be aliphatic compounds, such as monohydric and polyhydric alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived generally contain up to about 40 aliphatic carbon atoms, or from 2 to about 30, or from 2 to about 10. They may be monohydric alcohols such as methanol, ethanol, isooctanol, dodecanol, cyclohexanol, etc. In one embodiment, the hydroxy compounds are polyhydric alcohols, such as alkylene polyols. Preferably, the polyhydric alcohols contain from 2 to about 40 carbon atoms, from 2 to about 20; and or from 2 to about 10 hydroxyl groups, or from 2 to about 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, or from about 8 to about 18, provided that at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic, oleic, stearic, linoleic, dodecanoic and tall oil acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of the carboxylic acylating agents described above with one or more alcohols or phenols in ratios of from about 0.5 equivalent to about 4 equivalents of hydroxy compound per equivalent of acylating agent. The esterification is usually carried out at a temperature above about 100° C., or between 150° C. and 300° C. The water formed as a by-product is removed by distillation as the esterification proceeds. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines. The amine is added in an amount sufficient to neutralize any nonesterified carboxyl groups. In one embodiment, the nitrogen-containing carboxylic ester dispersants are prepared by reacting about 1.0 to 2.0 equivalents, or about 1.0 to 1.8 equivalents of hydroxy compounds, and up to about 0.3 equivalent, or about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

In another embodiment, the dispersant may also be derived from a Mannich dispersant. Mannich dispersants are generally formed by the reaction of at least one aldehyde, at least one of the above described amine and at least one alkyl substituted hydroxyaromatic compound. The reaction may occur from room temperature to 225° C., usually from 50° to about 200° C. (with from 75° C.–150° C. most preferred), with the amounts of the reagents being such that the molar ratio of hydroxyaromatic compound to formaldehyde to amine is in the range from about (1:1:1) to about (1:3:3).

The first reagent is an alkyl substituted hydroxyaromatic compound. This term includes phenols (which are preferred), carbon-, oxygen-, sulfur- and nitrogen-bridged phenols and the like as well as phenols directly linked through covalent bonds (e.g. 4,4'-bis(hydroxy)biphenyl), hydroxy compounds derived from fused-ring hydrocarbon (e.g., naphthols and the like); and polyhydroxy compounds such as catechol, resorcinol and hydroquinone. Mixtures of one or more hydroxyaromatic compounds can be used as the first reagent.

The hydroxyaromatic compounds are those substituted with at least one, and or not more than two, aliphatic or alicyclic groups having at least about 6 (usually at least about 30, or from at least 50) carbon atoms and up to about 400 carbon atoms, or up to about 300, or up to about 200. These groups may be derived from the above described polyalkenes. In one embodiment, the hydroxy aromatic compound is a phenol substituted with an aliphatic or alicyclic hydrocarbon-based group having an $\overline{M}n$ of about 420 to about 10,000.

The second reagent is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, paraldehyde, formalin and methal. Formaldehyde and its precursors (e.g., paraformaldehyde, trioxane) are preferred. Mixtures of aldehydes may be used as the second reagent.

The third reagent is any amine described above. Preferably the amine is a polyamine as described above. Mannich dispersants are described in the following patents: U.S. Pat. No. 3,980,569; U.S. Pat. No. 3,877,899; and U.S. Pat. No. 4,454,059 (herein incorporated by reference for their disclosure to Mannich dispersants).

In one embodiment, the dispersant is a borated dispersant. The borated dispersant are prepared by reacting one or more of the above dispersant is a borating agent. The following example relate to borated dispersants.

EXAMPLE C-1

A mixture of 372 grams (6 equivalents of boron) of boric acid and 3III grams (6 equivalents of nitrogen) of an acylated nitrogen composition, obtained by reacting 1 equivalent of a polybutenyl (n=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours a then filtered. The filtrate is found to have a boron content of 1.64% and a nitrogen content of 2.56%.

EXAMPLE C-2

(a) A reaction vessel is charged with 1000 parts of a polybutenyl (Mn=1000) substituted succinic anhydride, having a total acid number of 108, with a mixture of 275 grams of oil and 139 parts of a commercial mixture of polyamines corresponding to 85% E-100 amine bottoms and 15% diethylenetriamine. The reaction mixture is heated to 150 to 160° C. and the reaction temperature is maintained for four hours. The reaction is blown with nitrogen to remove water.

(b) A reaction vessel is charged with 1405 parts of the product of Example C-3a, 229 parts of boric acid, and 398 parts of diluent oil. The mixture is heated to 100 to 150° C. and the temperature maintained until water distillate ceases. The final product contains 2.3% nitrogen, 1.9% boron, 33% 100 neutral mineral oil and a total base number of 60.

Oil of Lubricating Viscosity

The lubricant and concentrate an oil of lubricating viscosity. The oil of lubricating viscosity is generally present in a major amount (i.e. an amount greater than about 50% by weight). In one embodiment, the oil of lubricating viscosity is present in an amount greater than about 60%, or greater than about 70%, or greater than about 80% by weight of the composition. The oils of lubricating viscosity include natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalphaolefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity is a polyalpha-olefin (PAO). Typically, the polyalpha-olefins are derived from monomers having from about 3 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140.

In one embodiment, the oil of lubricating viscosity is a mineral oil. The mineral oils have an iodine number of less than 9 and/or at least about 45% of the saturates present as aliphatic saturates. Iodine value is determined according to ASTM D-460. In one embodiment, the mineral oil has a iodine value less than about 8, or less than about 6, or less than about 4. The saturates level are determined by mass spectrometer. By mass spectroscopy, Group I stocks have about 70% saturates, Group II stocks have about 95% to about 98% saturates and Group III stocks have about 98%–100% saturates. Group II stocks have greater than 50% of their saturates present as cycloparaffinic compounds. The saturates of the mineral oils used in the present invention typically have at least about 45%, or at least about 50%, or at least about 60% aliphatic saturates. These aliphatic saturates are often referred to as paraffinic saturates. The cyclic saturates are generally referred to as cycloparaffinic saturates. Cyclic saturates compose the balance of the saturates in the mineral oils. The inventors have discovered that mineral oils having a higher proportion of aliphatic saturates have better oxidation properties and low temperature properties.

As use herein the term "mineral oil" refers to oils of lubricating viscosity which are derived from petroleum crude. The petroleum crudes may be subjected to processing such as hydroprocessing, hydrocracking, and isomerizing. Hydroprocessing includes processes such as sequential isocracking, isodewaxing and hydrofinishing. These mineral oils are those referred to as Group III basestock or base oils. In one embodiment, the mineral oil has less than 0.3% or less than 0.1% sulfur. In another embodiment, the oils of lubricating viscoisty generally have a viscosity index of 120 or more.

Examples of useful oils of lubricating viscosity include HVI and XHVI basestocks, such isomerized wax base oils and UCBO (Unconventional Base Oils) base oils. Specific examples of these base oils include 100N isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N solvent refined paraffinic mineral oil (0.16% sulfur/89 VI), 200N solvent refined naphthenic mineral oil (0.2% sulfur/60 VI), 100N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). Further examples of the mineral oils include those Group III basestocks made by Texaco such as the TEXHVI stocks which include TEXHVI-100N (95% saturates, 125 viscosity index and 0.02% sulfur); TEXHVI-70N (97.8% saturates, 123 viscosity index and 0.02% sulfur); Texaco "MOTIVA" TEXHVI 90N–100N (100% saturates, 125 viscosity index and 0.01% sulfur); and "MOTIVA" TEXHVI 75N (100% saturates, 125 viscosity index and 0.0% sulfur). Examples of useful Group III basestocks made by Chevron include UCBO 200N (100% saturates, 142 viscosity index and 0.005% sulfur); UCBO 100N (100% saturates, 129 viscosity index, and 0.004% sulfur).

Polymers

Often the multigrade lubricant will have at least one polymer present. The polymer generally is present in an amount from about 3% to about 40%, or from about 5% to about 35%, or from about 10% to about 30% by weight of the lubricating composition. The polymers include a polyalkene or derivative thereof, an ethylene-α-olefin copolymer, an ethylene-propylene polymer, an α-olefin-unsaturated carboxylic reagent copolymer, a polyacrylate, a polymethacrylate, a hydrogenated interpolymer of an alkenylarene and a conjugated diene, and mixtures thereof. Here, and else wherein the specification and claims, any member of a genus (or list) may be excluded from claims.

In one embodiment, the polymer is characterized by an $\overline{M}w$ (weight average molecular weight) of less than about 50,000, or less than about 45,000, or less than about 40,000. In one embodiment, the polymer has an $\overline{M}w$ of less than about 25,000, or less than about 10,000, or less than about 7,000. Typically the polymer has an $\overline{M}w$ of at least about 1,000, or at least about 2,000, or at least about 3,000.

In one embodiment, the polymer is characterized by an $\overline{M}n$ (number average molecular weight) of up to about 6000, or up to about 5000. Generally, the polymer is characterized by having an $\overline{M}n$ from about 800 to about 6000, or from about 900 to about 5000, or from about 1000 to 4000. In another embodiment, the polymers have a $\overline{M}n$ from about 1300 to about 5000, or from about 1500 to about 4500, or from about 1700 to about 3000. The polymers also generally have a $\overline{M}w/\overline{M}n$ from about 1.5 to about 8, or from about 1.8 to about 6.5, or from about 2 to about 5.5.

In one embodiment, the polymer may be a sheared polymer of higher molecular weight, e.g. greater than $\overline{M}w$ 50,000. In this embodiment, a higher molecular weight polymer is sheared to the desired molecular weight. The shearing may be done in any suitable apparatus, such as an extruder, an injector, an FZG apparatus, etc.

The abbreviation $\overline{M}w$ and $\overline{M}n$ is the conventional symbol representing weight average and number average molecular weight, respectively. Gel permeation chromatography (GPC) is a method which provides both molecular weights as well as the entire molecular weight distribution of the polymers. For purpose of this invention a series of fractionated polymers of isobutene, polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In one embodiment, the polymer is a polyalkene. The polyalkene includes homopolymers and interpolymers of olefins having from 2 to about 40, or from 3 to about 24, or from 4 to about 12 carbon atoms. The olefins may be monoolefins, such as ethylene, propylene, 1-butene, isobutene, an α-olefin, or polyolefinic monomers, including diolefinic monomers, such 1,3-butadiene and isoprene. The α-olefins generally have from about 4 to about 30, or from about 8 to about 18 carbon atoms. These olefins are sometimes referred to as mono-1-olefins or terminal olefins. The α-olefins and isomerized α-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available α-olefin fractions that can be used include the $C_{15-18}$ α-olefins, $C_{14-16}$ α-olefins, $C_{14-16}$ α-olefins, $C_{14-18}$ α-olefins, $C_{16-18}$ α-olefins, $C_{16-20}$ α-olefins, $C_{18-24}$ α-olefins, $C_{22-28}$ α-olefins, etc. The polyalkenes are prepared by conventional procedures. The polyalkenes are described in U.S. Pat. Nos. 3,219,666 and 4,234,435, the disclosures of which is hereby incorporated by reference. Examples of polyalkenes includes polypropylenes, polybutylenes, polyisoprene and polybutadienes. In one embodiment, the polyalkene is a homopolymer, such as a polybutene. One example of a useful polybutene is a polymer where about 50% of the polymer is derived from isobutylene. Useful polybutenes include those having an $\overline{M}w$ of about 4,000 to about 8,000, or 6,700.

In one embodiment, the polyalkene is derived from one or more dienes. The dienes include 1,3 pentadiene, isoprene, methylisoprene, 1,4-hexadiene, 1,5-hepatadiene, 1-6-octadiene, 5-ethylidene-2-norbornene, 5-methylene-2-norbornene, linear 1,3-conjugated dienes (e.g. 1,3-butadiene, 2,3-dimethyl-1,3-butadiene, and 1,3-hexadiene) and cyclic dienes (e.g. cyclopentadiene, dicyclopentadiene, fulvene, 1,3-cyclohexadiene, 1,3,5-cycloheptatriene, and cyclooctatetraene). The polyalkene may be a homopolymer of a diene, or a co- or terpolymer of a diene with either another diene or one or more of the above monoolefins. The polyalkene may be hydrogenated. A commercially available polyalkene derived from at least one diene is LIR-290, a hydrogenated polyisoprene ($\overline{M}w$=25,000), available commercially from Kuraray Co, Ltd.

In another embodiment, the polymer is a derivative of a polyalkene. The derivatives are typically prepared by reacting one or more of the above polyalkenes or a halogenated derivative thereof with an unsaturated reagent. The halogenated polyalkenes are prepared by reacting a polyalkene with a halogen gas, such as chlorine. The preparation of these materials is known to those in the art. The unsaturated reagents include unsaturated amines, ethers, and unsaturated carboxylic reagents, such as unsaturated acids, esters, and anhydrides. Examples of unsaturated amines include unsaturated amides, unsaturated imides, and nitrogen containing acrylate and methacrylate esters. Specific examples of unsaturated amines include acrylamide, N,N'-methylene bis (acrylamide), methacrylamide, crotonamide, N-(3,6-diazaheptyl) maleimide, N-(3-dimethylaminopropyl) maleimide, N-(2-methoxyethoxyethyl) maleimide, N-vinyl pyrrolidinone, 2- or 4-vinyl pyridine, dimethylaminoethyl methacrylate and the like.

In one embodiment, the unsaturated carboxylic reagent is an acid, anhydride, ester, or mixtures thereof. If an ester is desired, it can be prepared by reacting an unsaturated carboxylic acid or anhydride with a polyalkene or halogenated derivative thereof and subsequently reacting the reaction product with an alcohol to form the ester. The unsaturated carboxylic reagents include acrylic acid, methacrylic acid, cinnamic acid, crotonic acid, 2-phenylpropenoic acid, maleic acid, maleic anhydride, fumaric acid, mesaconic acid, itaconic acid and citraconic acid maleic, fumaric, acrylic, methacrylic, itaconic, and citraconic acids, esters, and anhydrides (where possible). The esters may be represented by one of the formulae: $(R_1)_2C{=}C(R_1)C(O)OR_2$, or $R_2O{-}(O)C{-}HC{=}CH{-}C(O)OR_2$, wherein each $R_1$ and $R_2$ are independently hydrogen or a hydrocarbyl group having 1 to about 30, or to about 12, or to about 8 carbon atoms, $R_1$ is hydrogen or an alkyl group having from 1 to about 6 carbon atoms. In one embodiment, $R_1$ is preferably hydrogen or a methyl group. In another embodiment, $R_2$ is an alkyl or hydroxyalkyl group having from about 1 to about 30, or from 2 to about 24, or from about 3 to about 18 carbon atoms. $R_2$ may be derived from one or more alcohols described below. Unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate and 2-ethylhexyl maleate. The above list includes mono- as well as diesters of maleic, fumaric, and itaconic acids and anhydrides.

The polyalkene derivatives are prepared by means known to those in the art. These materials have been referred to as hydrocarbyl substituted carboxylic acylating agents, and are discussed below. U.S. Pat. Nos. 3,219,666 and 4,234,435 describe the polyalkene derivatives and methods of making the same and are incorporated for such descriptions.

In another embodiment, the polymer is an ethylene-α-olefin copolymer. Typically, the copolymer is a random copolymer. The copolymer generally has from about 30% to about 80%, or from about 50% to about 75% by mole of ethylene. The α-olefins include butene, pentene, hexene or one more of the described above described α-olefins. In one embodiment, the α-olefin contains from about 3 to about 20, or from about 4 to about 12 carbon atoms. In one embodiment, the ethylene-α-olefin copolymers have an $\overline{M}w$ from about 10,000 up to about 40,000, or from about 15,000 up to about 35,000, or from about 20,000 up to about 30,000. In another embodiment, the ethylene-α-olefin copolymers have an $\overline{M}n$ from about 800 to about 6000, or from about 1500 to about 5000, or from about 2000 to about 4500. Examples of ethylene α-olefins copolymers include ethylene-butene copolymers and ethylene-octene copolymers. Examples of commercially available copolymers include Lucant HC 600 and Lucant HC 2000 ($\overline{M}w$=25,000), available from Mitsui Petrochemical Co., Ltd.

In another embodiment, the polymer is an ethylene propylene polymer. These polymers include ethylene propylene copolymers and ethylene propylene terpolymers. When the ethylene propylene polymer is an ethylene propylene copolymer (EPM, also called EPR polymers), it may be formed by copolymerization of ethylene and propylene under known conditions, preferably Ziegler-Natta reaction conditions. The preferred ethylene propylene copolymers contain units derived from ethylene in an amount from about 40% to about 70%, or from about 50% to about 60%, or about 55% by mole, the remainder being derived from propylene. The molecular weight distribution may be characterized by a polydispersity ($\overline{M}w/\overline{M}n$) from about 1 to about 8, or from about 1.2 to about 4.

In another embodiment, the ethylene propylene polymer is a terpolymer of ethylene, propylene and a diene monomer. In one embodiment, the diene is a conjugated diene. The dienes are disclosed above. The terpolymers are produced under similar conditions as those of the ethylene propylene copolymers. The preferred terpolymers contain units derived form ethylene in amount from about 10% to about 80%, or from about 25% to about 85%, or about 35% to about 60% by mole, and units derived from propylene in amount from about 15% to about 70%, or from about 30% to about 60% by mole, and units derived from diene third monomer in amount from about 0.5% to about 20%, or from about 1% to about 10%, or about 2% to about 8% by mole. The following table contains examples of ethylene propylene terpolymers.

| Example | Ethylene | Propylene | Diene |
|---|---|---|---|
| A | 42%* | 53% | 5% 1,5 heptadiene |
| B | 48% | 48% | 4% dicyclopentadiene |
| C | 45% | 45% | 10% 5-ethylidene-2-norbornene |
| D | 48% | 48% | 4% 1,6 octadiene |
| E | 48% | 48% | 4%, 4 cyclohexadiene |
| F | 50% | 45% | 4% 5-methylene-2-norbornene |

*Percentages are by mole

In one embodiment, the ethylene propylene polymer is a terpolymer of ethylene, propylene and dicyclopentadiene or ethylidene norbornene, available commercially as Trilene elastomers from the Uniroyal Corporation. A useful ethylene propylene terpolymer is Trilene CP-40. The ethylene propylene polymers are prepared by means know to those in the art. U.S. Pat. No. 3,691,078 describes ethylene propylene polymers and methods of preparing them, and is incorporated by reference for such disclosures.

In another embodiment, the polymer is a copolymer of an α-olefin and an unsaturated reagent. The α-olefins may be any of those discussed above, and include propylene, 1-butene, 2-methyl propene, 2-methyl-1-octene, and 1-decene. The unsaturated reagents are described above. The unsaturated carboxylic reagents include acrylates, methacrylates, maleates and fumarates. The α-olefin-unsaturated carboxylic reagent polymers are prepared by means known to those in the art. Examples of α-olefin-unsaturated carboxylic reagent copolymers include poly (octene-co-ethylacrylate), poly(decene-co-butylmethacrylate), poly(hexene-co-maleic anhydride), poly (octene-co-methyl fumarate) and the like.

In another embodiment, the polymer is a polyacrylate or polymethacrylate. The polyacrylates and polymethacrylates include homopolymers and interpolymers of one or more of the above described acrylic or methacrylic acids or esters. The polyacrylates and polymethacrylates include the Acryloid 1019 polymers, available from Rohm and Haas Company, Garbacryl 6335 available from Societe Francaise d'Organo-Sythese (SFOS), LZ 7720C available from The Lubrizol Corporation, and Viscoplex 0-101 polymers, available from Rohm Darmstadt.

In another embodiment, the polymer is a hydrogenated interpolymer of an vinyl substituted aromatic compound and a conjugated diene. The interpolymers include diblock, triblock and random block interpolymers. The vinyl substituted aromatic compounds generally have from about 8 to about 20, or from about 8 to about 18, or from about 8 to about 12 carbon atoms. Examples of vinyl substituted aromatics include styrene, α-methylstyrene, o-methylstyrene, m-methylstyrene, p-methylstyrene, p-t-butylstyrene, with styrene being preferred. The conjugated dienes are described above. Isoprene and 1,3-butadiene are preferred conjugated dienes.

The vinyl substituted aromatic content of these copolymers is in the range from about 20% to about 70%, or from about 40% to about 60% by weight. Thus, the conjugated diene content is in the range from about 30% to about 80%, or from about 40% to about 60% by weight. These interpolymers are prepared by conventional methods well known in the art. Such copolymers usually are prepared by anionic polymerization using, for example, an alkali metal hydrocarbon (e.g., sec-butyllithium) as a polymerization catalyst. Examples of suitable hydrogenated copolymers of a vinyl substituted aromatic compound and a conjugated diene include Shellvis-40, and Shellvis-50, both hydrogenated styrene-isoprene block copolymers, manufactured by Shell Chemicals.

Fluidizing Agent

The lubricating compositions may additionally contain at least one fluidizing agent. Generally, the fluidizing agent is present in an amount up to about 30% by weight. Typically the fluidizing agent is present in an amount from about 3% to about 30%, or from about 5% to about 28%, from about 10% to about 27%, or from about 15% to about 25% by weight of the lubricating composition. The amount of fluidizing agent equals the total amount of fluidizing agents in the lubricating compositions.

In one embodiment, the fluidizing agent is at least one member selected from the group consisting of an alkylated aromatic hydrocarbon, a naphthenic oil, a polyα-olefin having a kinematic viscosity from about 3 to about 20 cSt at 100° C., a carboxylic acid esters, and mixtures of two or more thereof. The alkylated aromatic hydrocarbons typically include mono- or di- (or mono-) substituted benzenes wherein the substituents are hydrocarbon-based groups having from about 8 to about 30, or from about 10 to about 14 carbon atoms. An example is Alkylate A-215 (a 237 molecular weight alkylated benzene) and Alkylate A-230 (a 230 molecular weight alkylated benzene) available from Monsanto.

The naphthenic oils are those derived from naphthenic crudes such as found in the Louisiana area. The viscosity of such naphthenic oils at 40° C. generally is less than 4 centistokes and more generally within the range of from about 3.0 to about 3.8 centistokes. At 100° C. the viscosity of the desirable naphthenic crudes is within the range of about 0.8 to about 1.6 centistokes.

The polyα-olefins (PAOs) are described above. Examples of useful PAOs include those derived from one or more of the above olefins, such as the α-olefins. These PAOs may have a viscosity from about 2 to about 30, or from about 3 to about 20, or from about 3 to about 8 cSt at 100° C. Examples of PAOs include 4 cSt polyα-olefins, 6 cSt polyα-olefins, and 8 cSt polyα-olefins. A particularly useful PAO is derived from decene.

The carboxylic ester fluidizing agents are reaction products of dicarboxylic esters with alcohols having from about 1 to about 30, or from about 2 to about 18, or from about 3 to about 12 carbon atoms. The alcohols are described below and include methyl, ethyl, propyl, butyl, hexyl, heptyl, octyl, decyl and dodecyl alcohols. The dicarboxylic acids generally contain from about 4 to about 18, or from about 4 to about 12, or from about 4 to about 8 carbon atoms. Examples of dicarboxylic acids include phthalic acid, succinic acid, alkyl ($C_{1-24}$)succinic acids, azelaic acid, adipic acid, and malonic acid. Particularly useful esters are dicarboxylic esters of $C_{1-12}$ alcohols, such as esters of propyl, butyl, pentyl, hexyl, and octyl alcohols and azelaic acid. In one embodiment, the lubricating compositions contain less than about 20%, or less than about 15% by weight of carboxylic ester fluidizing agent.

The above-described mineral oil may be used with commercially available gear and transmission concentrates such as those sold by Exxon, Lubrizol, Ethyl and Mobil corporations. In this embodiment, those commercial concentrates are diluted with the basestocks to form the transmission and gear formulations.

The combinations may be used in lubricants or in concentrates. The concentrate may contain the above combinations and/or other components used in preparing fully formulated lubricants. The concentrate also contains a substantially inert organic diluent, which includes kerosene, mineral distillates, or one or more of the oils of lubricating viscosity discussed below. The combinations are present in a final product, blend, or concentrate in any amount effective to act as an antiwear, antiweld, and/or extreme pressure agents in lubricating compositions.

In one embodiment, the lubricating compositions is free of sulfuried olefins and fatty acids or esters. In another embodiment, the lubricating composition is free of overbased metal salt other than the above described molybdenum overbased salts. In another embodiment, the lubricating compositions is free of zinc dithiophosphates. In another embodiment, the lubricating composition is free of added lead compounds, such as lead napthanates, dithiophosphates and dithiocarbamates. In another embodiment, the lubricating composition is free of succinimides derived from olefins or polyolefins and ammonia or a mono-amine.

Other Additives

The invention also contemplates the use of other additives together with the above combinations. Such additives include, for example, detergents and dispersants, corrosion- and oxidation-inhibiting agents, pour point depressing agents, extreme pressure agents, antiwear agents, color stabilizers and anti-foam agents.

The detergents are exemplified by oil-soluble neutral and basic salts (i.e. overbased salts) of alkali or alkaline earth metals with sulfonic acids, carboxylic acids, phenols or organic phosphorus acids, such as those described above. The oil-soluble neutral or basic salts of alkali or alkaline earth metal salts may also be reacted with a boron compound. The overbased and borated overbased metal salts are described above. Examples of useful overbased and borated overbased metal salts include sodium, calcium and magnesium overbased and borated overbased sulfonates and carboxylates, including the above hydrocarbyl substituted carboxylic acylating agents.

Auxiliary extreme pressure agents and corrosion- and oxidation-inhibiting agents which may be included in the lubricants of the invention are exemplified by chlorinated aliphatic hydrocarbons such as chlorinated waxes; sulfurized alkylphenols; phosphosulfurized hydrocarbons, such as the reaction product of a phosphorus sulfide with turpentine or methyl oleate; metal thiocarbamates, such as zinc dioctyidithiocarbamate, and barium diheptylphenyl dithiocarbamate; and ashless dithiocarbamates such as reaction products of a dithiocarbamic acid and an unsaturated acid, ester, anhydride, amide, ether, or imide. Many of the above-mentioned extreme pressure agents and corrosion- and oxidation-inhibitors also serve as antiwear agents.

Pour point depressants are an additive often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Antifoam agents are used to reduce or prevent the formation of stable foam. Typical antifoam agents include silicones or organic polymers. Additional antifoam compositions are described in "Foam Control Agents", by Henry T. Kerner (Noyes Data Corporation, 1976), pages 125–162.

The following examples relate to lubricating compositions containing the combination of a dithiocarbamate compound and an organic polysulfide.

EXAMPLE 1

A lubricant is prepared by incorporating 0.8 parts by weight of the product of Molyvan 807, 1.1 parts of the product of Example B-3 and 1.2 parts of the product of Example C-2 into a 80W-90 gear oil base oil.

EXAMPLE 2

A manual transmission lubricant is prepared by blending into a manual transmission base stock, 0.5 parts of the Molyvan 807 with 0.5 parts of the product of Example B-3, and 0.75 parts of the product of Example C-2.

EXAMPLE 3

A lubricating composition is described as in Example 2 with the addition of 0.75 parts of dinonyidiphenylamine, and 0.25 parts of ethoxylated phenol antioxidant.

EXAMPLE 4

A lubricating composition is described as in Example 3, except 0.7% of the product of Example B-2 is used in place of the product of Example B-3.

EXAMPLE 5

A lubricating composition is described as in Example 3, except 0.2% by weight of Sakura Lube 500 is used in place of the Molyvan 807.

EXAMPLE 6

A lubricating composition is described as in Example 3, except 0.5% of dibutyl phosphite is used in place of the product of Example B-3.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising a major amount of an oil of lubricating viscosity, (A) an antiwear improving amount of at least one molybdenum containing dithiocarbamate or thiophosphate, wherein (A) is present in an amount to provide from about 100 to about 900 ppm molybdenum to the lubricating composition, (B) at least one phosphorus antiwear or extreme pressure agent, and (C) at least one dispersant, provided that the lubricating composition is free of sulfurized olefins, wherein the phosphorus antiwear of extreme pressure agent is a phosphoric acid ester or salts thereof reacted with ammonia or an amine.

2. The lubricating composition of claim 1 wherein the phosphoric acid ester or salt thereof is a phosphoric acid ester prepared by reacting a dithiophosphoric acid with an epoxide to form an intermediate, and the intermediate is further reacted with a phosphorus acid or anhydride, or a salt of the phosphoric acid ester.

3. The lubricating composition of claim 2 wherein the dithiophosphoric acid is a dihydrocarbyl dithiophosphoric acid independently having from 1 to about 24 carbon atoms in each hydrocarbyl group.

4. The lubricating composition of claim 1 wherein the amine is a tertiary aliphatic primary amine.

5. The lubricating composition of claim 1 wherein the phosphoric acid ester or salt thereof is a phosphoric acid ester prepared by reacting a phosphorus acid or anhydride with at least one alcohol wherein each alcohol independently contains from about 1 to about 30 carbon atoms, or a salt of the phosphoric acid ester.

6. The lubricating composition of claim 1 wherein (B) is di or trihydrocarbyl phosphite, wherein each hydrocarbyl group independently contains from 1 to 30 carbon atoms.

7. The lubricating composition of claim 1 wherein (C) is selected from (a) acylated nitrogen dispersants, (b) hydrocarbyl substituted amines, (c) carboxylic ester dispersants, (d) Mannich dispersants, and (e) mixtures thereof.

8. The lubricating composition of claim 1 wherein the dispersant (C) is a borated dispersant.

9. The lubricating composition of claim 1 wherein (A) is molybdenum dithiocarbamate and contains about 2 to about 6 hydrocarbyl groups.

10. The lubricating composition of claim 9 wherein the molybdenum dithiocarbamate hydrocarbyl groups independently have from about 1 to about 30 carbon atoms.

11. The lubricating composition of claim 9 wherein the molybdenum dithiocarbamate hydrocarbyl groups independently have from about 4 to about 18 carbon atoms.

12. The lubricating composition of claim 10 wherein the molybdenum dithiocarbamate hydrocarbyl groups are alkyl.

13. The lubricating composition of claim 1 wherein the molybdenum dithiocarbamate is at least one of a simple metal dithiocarbamate, oxygen complexes with dithiocarbamoyl moieties, sulfur complexes with dithiocarbamoyl moieties or molybdenum oxysulfide thiocarbamates.

* * * * *